US010035249B2

(12) United States Patent
Chen et al.

(10) Patent No.: US 10,035,249 B2
(45) Date of Patent: Jul. 31, 2018

(54) STAPLER AND MULTI-INCLINED ANVIL STRUCTURE THEREOF

(71) Applicant: SDI CORPORATION, Chang Hua (TW)

(72) Inventors: Ching-Li Chen, Chang Hua (TW); Cheng-Chang Huang, Chang Hua (TW); Chyi-Feng Huang, Chang Hua (TW)

(73) Assignee: SDI Corporation, Chang Hua (TW)

( * ) Notice: Subject to any disclaimer, the term of this patent is extended or adjusted under 35 U.S.C. 154(b) by 448 days.

(21) Appl. No.: 14/737,587

(22) Filed: Jun. 12, 2015

(65) Prior Publication Data

US 2016/0129572 A1 May 12, 2016

(30) Foreign Application Priority Data

Nov. 6, 2014 (TW) ..... 103138601 A

(51) Int. Cl.
*B25C 5/02* (2006.01)

(52) U.S. Cl.
CPC ..... *B25C 5/0278* (2013.01); *B25C 5/0207* (2013.01)

(58) Field of Classification Search
CPC ..... B27F 7/19; B25C 5/0207
USPC ..... 227/119, 120, 155
See application file for complete search history.

(56) References Cited

U.S. PATENT DOCUMENTS

| | | | | |
|---|---|---|---|---|
| 5,350,400 | A | 9/1994 | Esposito | |
| 5,480,089 | A | 1/1996 | Blewett | |
| 8,002,161 | B2 * | 8/2011 | Maemori | B25C 5/0207 227/119 |
| 2010/0059569 | A1 | 3/2010 | Maemori | |
| 2013/0032624 | A1 * | 2/2013 | Yagi | B27F 7/19 227/155 |

FOREIGN PATENT DOCUMENTS

| | | | |
|---|---|---|---|
| CN | 203245828 | U | 10/2013 |
| JP | H0184982 | U | 6/1989 |
| JP | H1128682 | A | 2/1999 |
| JP | 2004276196 | A | 10/2004 |
| JP | 200880450 | A | 4/2008 |
| JP | 2009012095 | A | 1/2009 |
| JP | 5056214 | B2 | 10/2012 |
| TW | 200909153 | A | 3/2009 |

(Continued)

*Primary Examiner* — Nathaniel Chukwurah
(74) *Attorney, Agent, or Firm* — Rosenberg, Klein & Lee

(57) ABSTRACT

A multi-inclined anvil structure for a stapler has a body, an operating portion and a flattening surface. The body has a horizontal imaginary plane. The operating portion is recessed downward in the top of the body and has a projection plane that has a narrow front and a wide rear. The flattening surface is formed in a bottom surface of the operating portion and has two inclined bottom portions. Each inclined bottom portion is inclined and has a high front and a low rear relative to the horizontal imaginary plane. An inclined bottom angle is formed between an extension direction of the inclined bottom portions and the horizontal imaginary plane. When the stapler is applied to staple a few sheets of paper, a staple-sliding problem can be resolved. When the stapler is applied to staple many sheets of paper, a well-clinched quality can be provided.

20 Claims, 9 Drawing Sheets

(56) References Cited

FOREIGN PATENT DOCUMENTS

| | | | |
|---|---|---|---|
| TW | I364353 | B | 5/2012 |
| TW | I409146 | B | 9/2013 |
| TW | I410310 | B | 10/2013 |
| WO | 03090975 | A1 | 11/2003 |

* cited by examiner

STAPLER AND MULTI-INCLINED ANVIL STRUCTURE THEREOF

BACKGROUND OF THE INVENTION

1. Field of the Invention

The present invention relates to a stapler and a component of the stapler, and more particularly to a stapler and a multi-inclined anvil structure thereof.

2. Description of Related Art

A conventional stapler has an anvil. The anvil is applied for clinching two legs of a staple, such that sheets of paper can be stapled and assembled, and the clinched staple can be kept from piercing through sheets of paper or injuring a user.

With reference to FIGS. 8 to 9B, a conventional anvil of a stapler comprises an anvil body 50. A top of the anvil body 50 is recessed and has two inclined portions 51, a planar portion 52 and two bending portions 53. The recessed top of the anvil body 50 has a uniform width. A depth B of the top of the anvil body 50 is 0.8 millimeters. The inclined portions 51 are respectively formed on a front side and a rear side of the top of the anvil body 50, and are formed opposite to each other. The front side of the anvil body 50 is distal from a pivot position of the stapler, and the rear side of the anvil body 50 faces to the pivot position of the stapler. The planar portion 52 is formed on a bottom surface of the recessed top of the anvil body 50. The planar portion 52 is planar relative to the top of the anvil body 50. The bending portions 53 are respectively connected with two ends of the planar portion 52, and the bending portions 53 are curved. When the stapler is stapling, an arm of the stapler is pressed downward, two legs of the staple are respectively bent by the two bending portions 53, and the legs of the staple extend and are flattened along the planar portion 52.

However, the width of the recessed top of the conventional anvil body 50 is uniform from a front side to a rear side of the anvil body 50, and the planar portion 52 is horizontal relative to the top of the anvil body 50. Therefore, during stapling, the legs of the staple piercing through the sheets of paper are not positioned easily, and a stapling quality is relatively unstable. When the stapler is applied to staple a few sheets of paper, such as two sheets, a sliding phenomenon occurs at the legs of the staple easily. When the stapler is applied to staple many sheets of paper, such as more than twenty sheets, a piercing width between the legs of the staple piercing through the paper becomes narrowed, such that the legs of the staple cannot be clinched well easily. The legs of the staple that are not clinched well will injure a user easily.

To resolve the aforementioned problems, with reference to FIG. 6C of TW patent No. I409146, an anvil body having an inclined bottom surface is disclosed. A front side of the inclined bottom surface of the anvil body is higher than a rear side of the inclined bottom surface of the anvil body. When the stapler is stapling, although the legs of the staple can be kept from sliding toward the front side, the piercing width between the legs of the staple piercing through the sheets of paper still becomes narrowed when stapling many sheets of paper, such that the legs of the staple are not clinched well and flattened easily.

Further with reference to TW patent No. I409146, the anvil body has a horizontal bottom surface and an inclined bottom surface. The horizontal bottom is located at a rear side of the inclined bottom surface, and the inclined bottom surface of the anvil body is formed as a structure that has a high front and a low rear. When the stapler is stapling a few sheets of paper, a piercing working plane of the staple is the horizontal bottom surface, and a piercing direction of the staple is perpendicular to the horizontal bottom surface. When the stapler is stapling many sheets of paper, the legs of the staple approach toward the inclined bottom surface. However, the bottom of the anvil body needs to form the horizontal bottom surface and the inclined bottom surface. As a result, during stapling, the legs of the staple are relatively harder to be positioned. Furthermore, the bottom of the anvil body has a relatively larger size along an extension direction between the front side and the rear side of the anvil body, such that during stapling, the legs of the staple may be askew relative to the anvil body, and a manufacturing cost of the anvil body with the anvil structure is increased.

SUMMARY OF THE INVENTION

To resolve problems of staple-sliding, staple being not clinched well, and staple being askew that occur easily when a conventional anvil structure of a conventional stapler is stapling, and to resolve the problem of high manufacturing cost, the main objective of the present invention is to provide a stapler and a multi-inclined anvil structure thereof that can be suitable for stapling both many sheets of paper and a few sheets of paper, can be kept from a situation that two legs of a staple are askew relative to the anvil structure, and have a relatively low manufacturing cost.

The multi-inclined anvil structure is applied for bending an ejected staple, and the multi-inclined anvil structure has a body, a first side, a second side and a top. The body has a horizontal imaginary plane. The second side is opposite to the first side.

The operating portion is formed in the body and located between the first side and the second side. The operating portion is recessed downward in the top of the body to form a recess and has a bottom surface. The operating portion has a projection plane that is parallel with the horizontal imaginary plane, wherein a part of the projection plane adjacent to the first side is narrower than a part of the projection plane adjacent to the second side.

The flattening surface is formed in the bottom surface of the operating portion and has two inclined bottom portions being inclined relative to the horizontal imaginary plane. An inclined state of each inclined bottom portion is that a position of the inclined bottom portion adjacent to the first side is higher than a position of the inclined bottom portion distal from the second side. An inclined bottom angle is formed between an extension direction of the inclined bottom portions and an extension direction of the horizontal imaginary plane.

The stapler has a base, an arm assembly, a magazine assembly and a multi-inclined anvil structure.

The base has a clinching end. The arm assembly is pivotally mounted on the base. The magazine assembly is pivotally mounted on the base, and is located between the arm assembly and the base.

The multi-inclined anvil structure is mounted on the clinching end of the base and has a body, an operating portion and a flattening surface. The body has a horizontal imaginary plane, a first side, a second side opposite to the first side, and a top facing toward the arm assembly. The operating portion is formed in the body and located between the first side and the second side. The operating portion is recessed downward in the top of the body to form a recess and has a bottom surface. The operating portion has a projection plane that is parallel with the horizontal imaginary plane, wherein a part of the projection plane adjacent to the first side is narrower than a part of the projection plane adjacent to the second side. The flattening surface is formed in the bottom surface of the operating portion and has two inclined bottom portions being inclined relative to the horizontal imaginary plane. An inclined state of each inclined bottom portion is that a position of the inclined bottom portion adjacent to the first side is higher than a position of the inclined bottom portion distal from the second side. An inclined bottom angle is formed between an extension direction of the inclined bottom portions and an extension direction of the horizontal imaginary plane.

Other objectives, advantages and novel features of the present invention will become more apparent from the following detailed description when taken in conjunction with the accompanying drawings.

DETAILED DESCRIPTION OF PREFERRED EMBODIMENT

Figure 1:
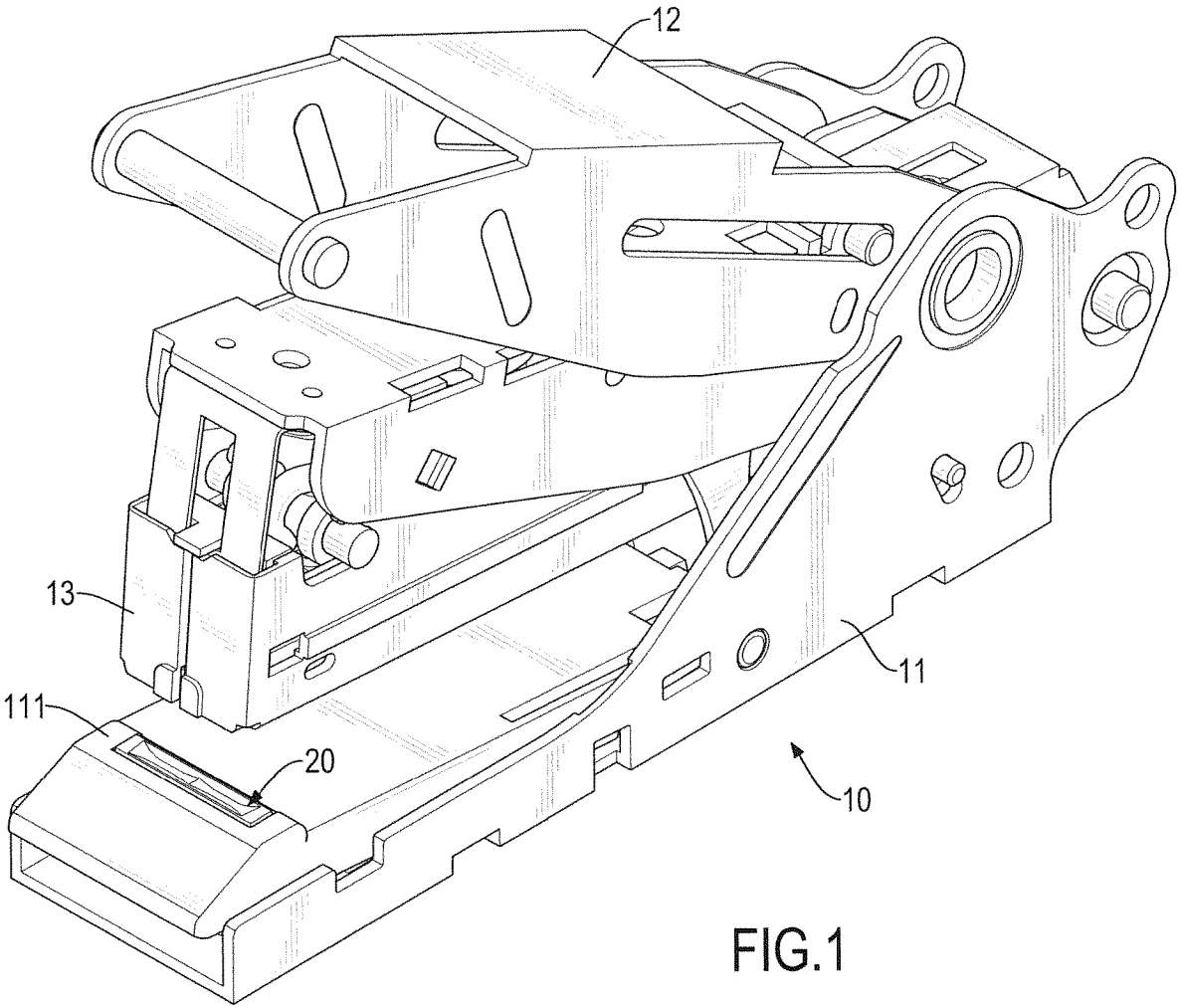
FIG. 1 is a perspective view of a preferred embodiment of a stapler in accordance with the present invention.
Figure 2:
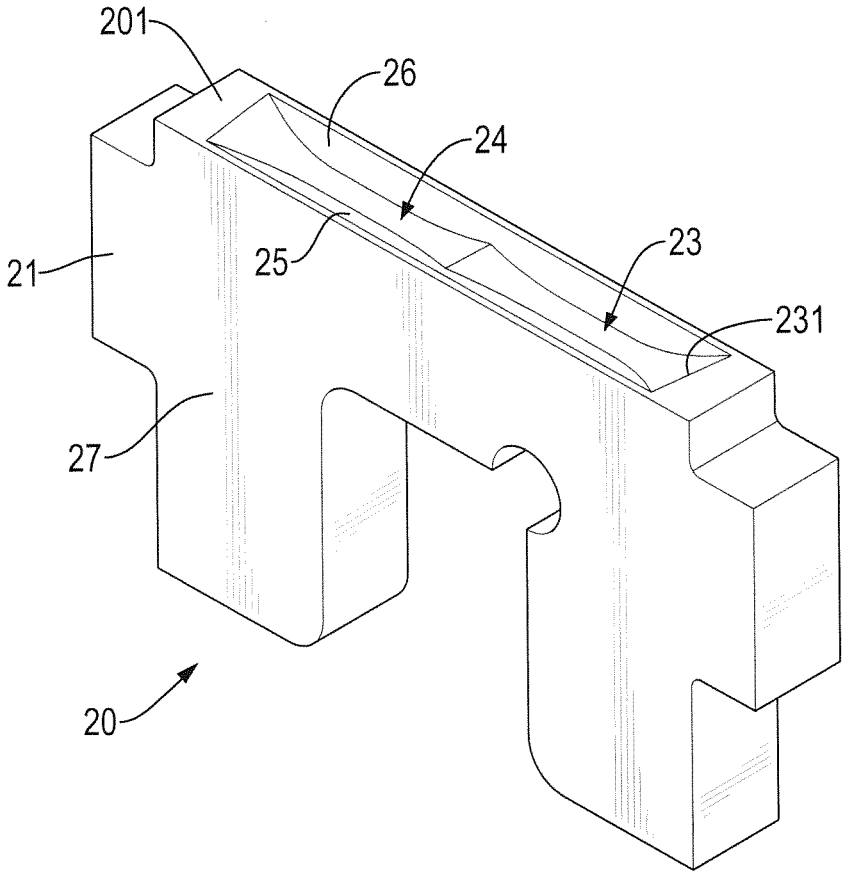
FIG. 2 is a perspective view of a multi-inclined anvil structure in accordance with the present invention.
Figure 3:
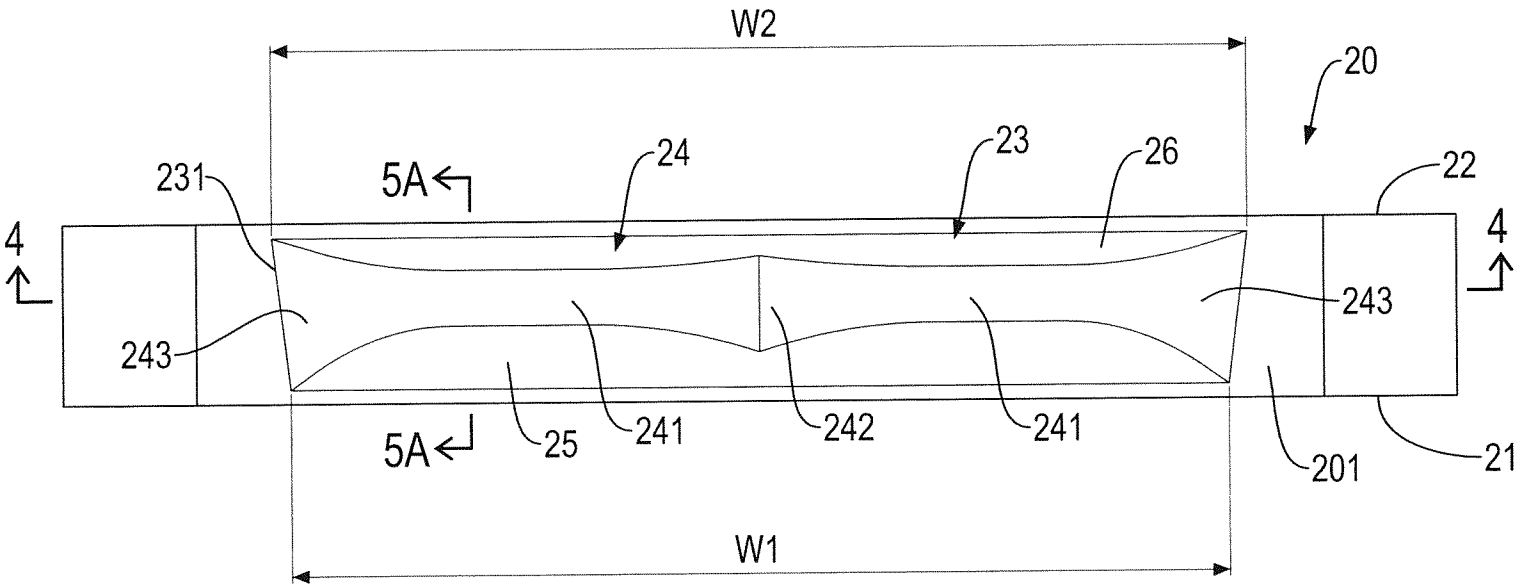
FIG. 3 is a top view of the multi-inclined anvil structure in FIG. 2.

With reference to FIG. 1, a preferred embodiment of a stapler 10 in accordance with the present invention has a base 11, an arm assembly 12, a magazine assembly 13, and a multi-inclined anvil structure 20. The base 11 has a clinching end 111. The arm assembly 12 is pivotally mounted on the base 11. The magazine assembly 13 is pivotally mounted on the base 11 and is located between the arm assembly 12 and the base 11. The multi-inclined anvil structure 20 is mounted on the clinching end 111 of the base 10 and faces toward the arm assembly 12. The multi-inclined anvil structure 20 is provided for clinching a staple ejected by the magazine assembly 13. The multi-inclined anvil structure 20 may be an individual anvil element. Alternatively, the multi-inclined anvil structure 20 may be integrally formed on the clinching end 111. In the preferred embodiment, the multi-inclined anvil structure 20 is an individual anvil element. When the base 11 and the arm assembly 12 are forced to press inwardly relative to each other, a staple in the magazine assembly 13 can be pushed out of the magazine assembly 13 and abut the multi-inclined anvil structure 20. Then, while the base 11 and the arm assembly 12 are continuously forced and further pressed inwardly, two legs of the staple are forced, can be bent by the multi-inclined anvil structure 20 and further be flattened, such that a paper stapling operation can be completed.

With reference to FIGS. 2 to 5B, the multi-inclined anvil structure 20 has a body 27, an operating portion 23, a flattening surface 24, a high-sheet-capacity operating surface 25 and a low-sheet-capacity operating surface 26. The body 27 has a horizontal imaginary plane P, a top 201, a first side 21 and a second side 22. The top 201 faces toward the magazine assembly 13. The first side 21 is located at a side of the multi-inclined anvil structure 20 opposite to a pivot position between the base 11 and the arm assembly 12. The second side 22 is opposite to the first side 21, and the second side 22 is located at a side of the multi-inclined anvil structure 20 facing to the pivot position between the base 11 and the arm assembly 12. The horizontal imaginary plane P is a plane that is perpendicular to two legs of a staple ejected by the magazine assembly 13. Preferably, an extension surface of the first side 21 and an extension surface of the second side 22 are respectively perpendicular to the horizontal imaginary plane P. The operating portion 23 is formed in the body 27 and is located between the first side 21 and the second side 22. The operating portion 23 is formed in the top 201 of the body 27. The operating portion 23 is provided for bending and flattening staples. The operating portion 23 is recessed downward in the top 201 to form a recess and has a bottom surface. The operating portion 23 has a projection plane 231 that is parallel with the horizontal imaginary plane P. A width W1 of a side of the projection plane 231 that is adjacent to the first side 21 is narrower than a width W2 of a side of the projection plane 231 that is adjacent to the second side 22, such that the projection plane 231 is formed as a structure that has a narrow front and a wide rear. Preferably, the projection plane 231 is formed as a trapezoid. The width W1 of the projection plane 231 that is adjacent to the first side 21 is less than the width W2 of the projection plane 231 that is adjacent to the second side 22.

The flattening surface 24, the high-sheet-capacity operating surface 25 and the low-sheet-capacity operating surface 26 are formed in the operating portion 23. The flattening surface 24 is formed on the bottom surface of the operating portion 23. The flattening surface 24 has two inclined bottom portions 241, a connecting portion 242 and two first contact portions 243. The connecting portion 242 is connected between the two inclined bottom portions 241. The first contact portions 243 are respectively connected with ends of the two inclined bottom portions 241 at positions opposite to the connecting portion 242, such that the flattening surface 24 is formed as a structure that is left-right symmetrical relative to the connecting portion 242. The inclined bottom portions 241 are inclined relative to the horizontal imaginary plane P, and an inclined state of each inclined bottom portion 241 is that a part of the inclined bottom portion 241 adjacent to the first side 21 is higher than a part of the inclined bottom portion 241 distal from the first side 21. Therefore, the inclined state of each inclined bottom portion 241 has a high front and a low rear. An inclined bottom angle A1 is formed between an extending direction of the inclined bottom portions 241 and an extension direction of the horizontal imaginary plane P. A range of the inclined bottom angle A1 is 2.5 degrees to 3 degrees. Preferably, the inclined bottom angle A1 is 3 degrees. Each inclined bottom portion 241 has a first end and a second end. The first end of the inclined bottom portion 241 is defined as an end of the inclined bottom portion 241 adjacent to the first side 21. The second end of the inclined bottom portion 241 is defined as an end of the inclined bottom portion 241 adjacent to the second side 22. A depth D is formed between the second end of the inclined bottom portion 241 and the top 201 of the body 27. The depth D is 0.5 millimeters. Each inclined bottom portion 241 has an inclined bottom width W3 defined as being parallel with the horizontal imaginary plane P, such that the inclined bottom width W3 is a horizontal distance between the first end and the second end of the inclined bottom portion 241. The inclined bottom width W3 is 0.8 millimeters. The connecting portion 242 is formed as a structure that has a protrusion formed at a middle of the connecting portion 242. The first contact portions 243 extend from the inclined bottom portions 241 toward the top 201 of the body 27. When the stapler 10 is applied for stapling paper, the two first contact portions 243 are as first contact positions between two legs of a staple and the multi-inclined anvil structure 20. The legs of the staple are bent on the two first contact portions 243.

The high-sheet-capacity operating surface 25 is connected with a front end of the flattening surface 24 and is inclined. A high-sheet-capacity operating angle A2 is formed between the high-sheet-capacity operating surface 25 and the first side 21. The low-sheet-capacity operating surface 26 is connected with a rear end of the flattening surface 24 and is inclined. A low-sheet-capacity operating angle A3 is formed between the low-sheet-capacity operating surface 26 and the second side 22. The high-sheet-capacity operating angle A2 is larger than the low-sheet-capacity operating angle A3. A range of the high-sheet-capacity operating angle A2 is 55 degrees to 65 degrees. Preferably, the high-sheet-capacity operating angle A2 is 60 degrees. When the stapler 10 is applied to stapling many sheets of paper, such as more than twenty sheets, the high-sheet-capacity operating surface 25 is a forcible positioning point for the legs of the staple. A range of the low-sheet-capacity operating angle A3 is 35 degrees to 45 degrees. Preferably, the low-sheet-capacity operating angle A3 is 40 degrees. When the stapler 10 is applied for stapling a few sheets of paper, such as two sheets, the inclined bottom portions 241 can position the legs of the staple, and the low-sheet-capacity operating surface 26 can abut the legs of the staple to eliminate a problem that the legs of the staple are askew while stapling.

Figure 4:
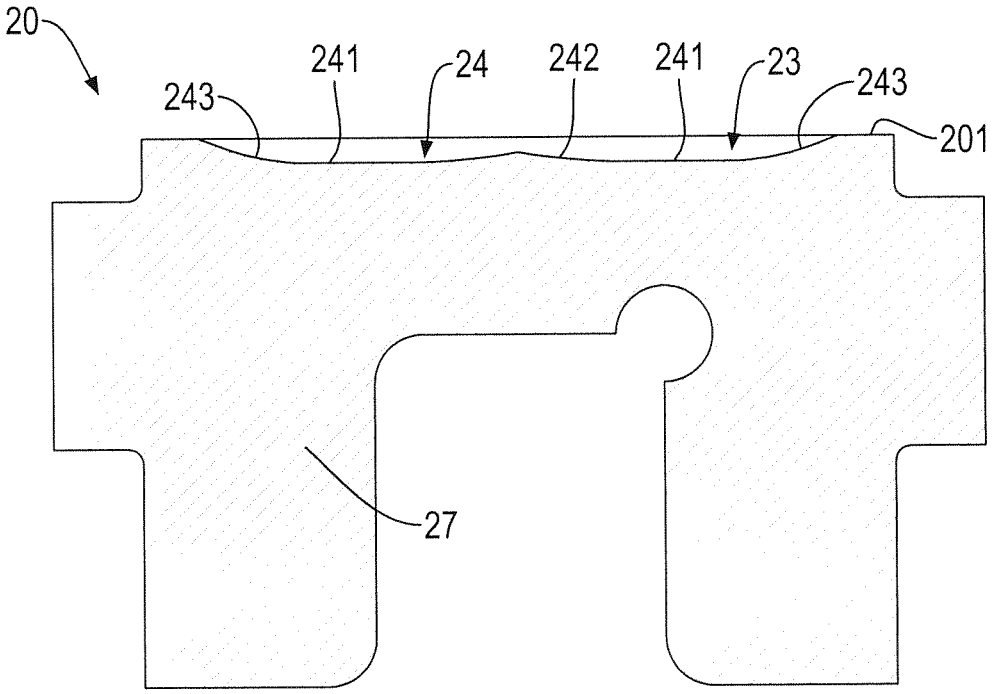
FIG. 4 is a cross sectional front view of the multi-inclined anvil structure along line 4-4 in FIG. 3.

With reference to FIGS. 1 and 4, in use, when the base 11 and the arm assembly 12 of the stapler 10 are pressed inwardly and approach each other, a staple in the magazine assembly 13 can be pushed out of the magazine assembly 13. Two legs of the staple first abut the first contact portions 243. The legs of the staple are forcibly bent. When the base 11 and the arm assembly 12 are further forced, the legs of the staple are deformed along extension directions of the first contact portions 243 and the inclined bottom portions 241 of the flattening surface 24, such that the staple can be stapled on sheets of paper in a flat-chinch state.

Figure 6A:
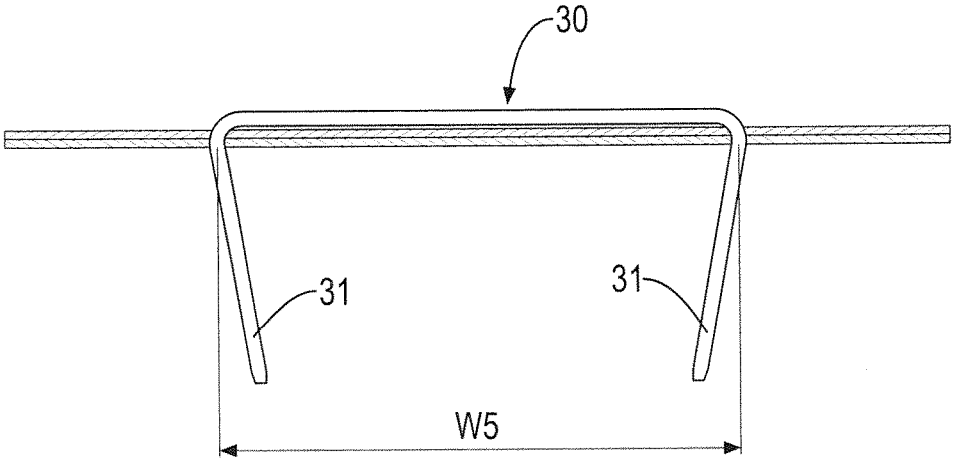
FIG. 6A is an operational front view in partial section of a staple stapling a few sheets of paper.
Figure 6B:
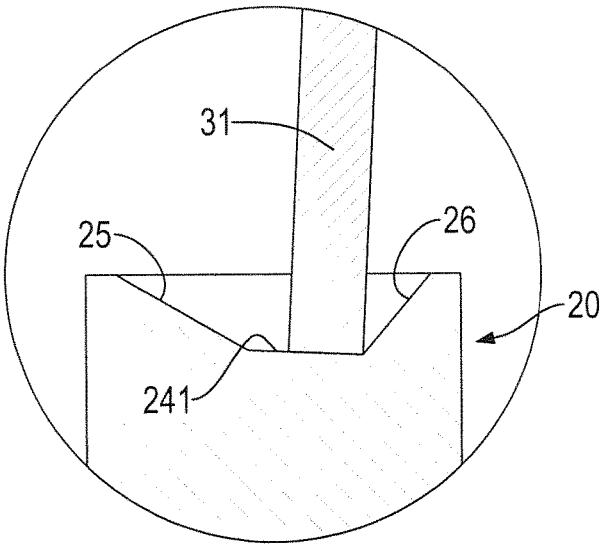
FIG. 6B is an operational cross sectional front view of the staple stapling a few sheets of paper.

With reference to FIGS. 6A and 6B, when the stapler 10 is applied for stapling a few sheets of paper, two legs 31 of a staple 30 can abut the inclined bottom portions 241 of the flattening surface 24. The legs 31 of the staple 30 can slide along the inclined bottom portions 241 and abut the low-sheet-capacity operating surface 26, and the legs 31 of the staple 30 are positioned at a connection position between the inclined bottom portions 241 and the low-sheet-capacity operating surface 26. Therefore, positioning problem of the staple 30 during stapling a few sheets of paper can be improved to avoid problem of staple-sliding and a situation that the legs 31 of the staple are askew when the stapler 10 is stapling a few sheets of paper.

Figure 7A:
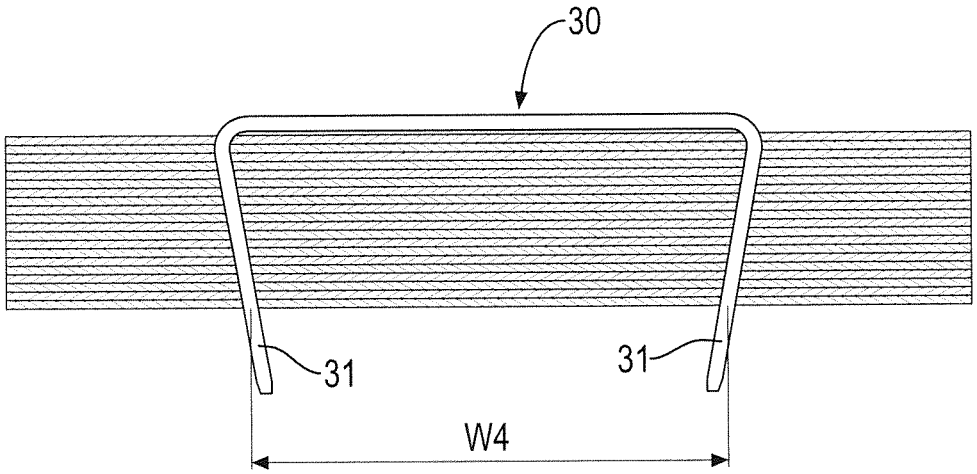
FIG. 7A is an operational front view in partial section of the staple stapling many sheets of paper.
Figure 7B:
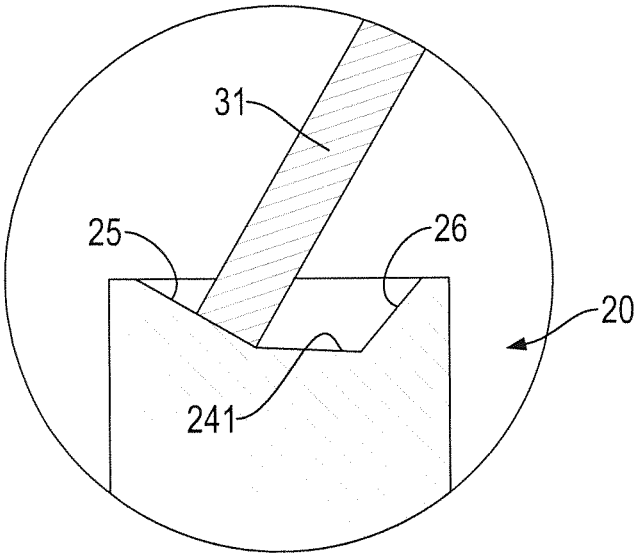
FIG. 7B is an operational front view of the staple stapling many sheets of paper.
Figure 8:
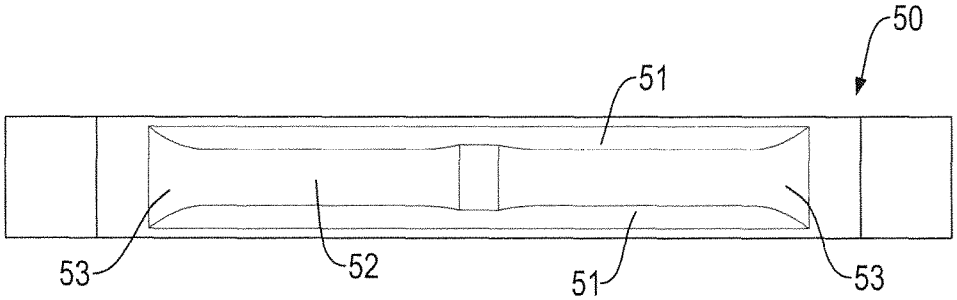
FIG.8 PRIOR ART
FIG. 8 is a top view of a conventional anvil structure.
Figure 9A:
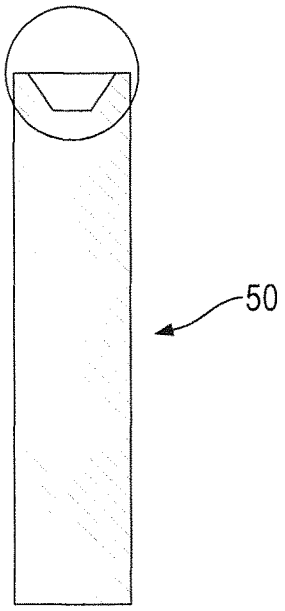
FIG.9A PRIOR ART
FIG. 9A is a cross sectional side view of the conventional anvil in FIG. 8.
Figure 9B:
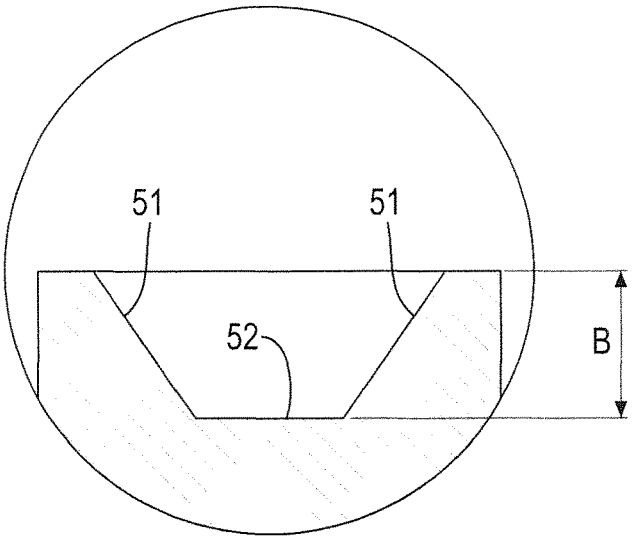
FIG.9B PRIOR ART
FIG. 9B is a partially enlarged side view of the conventional anvil in FIG. 9A.

With reference to FIGS. 6A and 7A, when the stapler 10 is applied for stapling many sheets of paper, a piercing width W4 between the legs 31 of the staple 30 piercing through the many sheets of paper becomes narrowed, since a total thickness of the many sheets of paper is thicker than a total thickness of the few sheets of paper. Therefore, the piercing width W4 between the legs 31 of the staple 30 stapling many sheets of paper is less than a piercing width W5 between the legs 31 of the staple 30 stapling a few sheets of paper. Further with reference to FIGS. 3, 7A and 7B, when the stapler 10 is stapling many sheets of paper, at first, the legs 31 of the staple 30 can abut the high-sheet-capacity operating surface 25 and abut a connection position between the inclined bottom portions 241 and the high-sheet-capacity operating surface 25. Therefore, the connection position between the inclined bottom portions 241 and the high-sheet-capacity operating surface 25 is as a forcible positioning point for the legs 31 of the staple 30. Furthermore, the width W1 of the projection plane 231 of the operating portion 23 adjacent to the first side 21 is narrower than the width W2 of the projection plane 231 of the operating portion 23 adjacent to the second side 22. Therefore, a phenomenon that the piercing width W4 of the legs 31 of the staple 30 becomes narrowed during stapling many sheets of papers can be resolved, such that an ejection state of the staple 30 can be positioned and regulated easily. While the legs 31 of the staple 30 are sliding, the legs 31 of the staple 30 can be smoothly positioned at the connection position between the high-sheet-capacity operating surface 25 and the inclined bottom portion 241, and can be flattened smoothly to resolve a problem that the legs 31 of the staple 30 do not be clinched well.

Figure 5A:
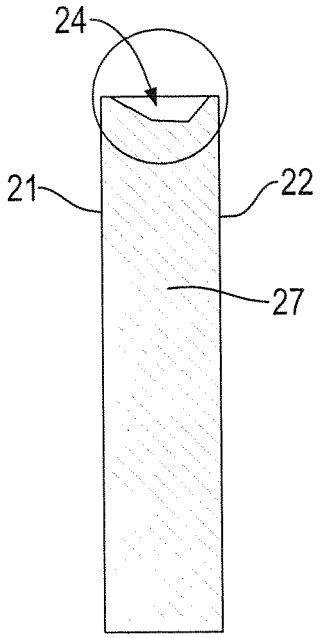
FIG. 5A is a cross sectional side view of the multi-inclined anvil structure along line 5A-5A in FIG. 3.
Figure 5B:
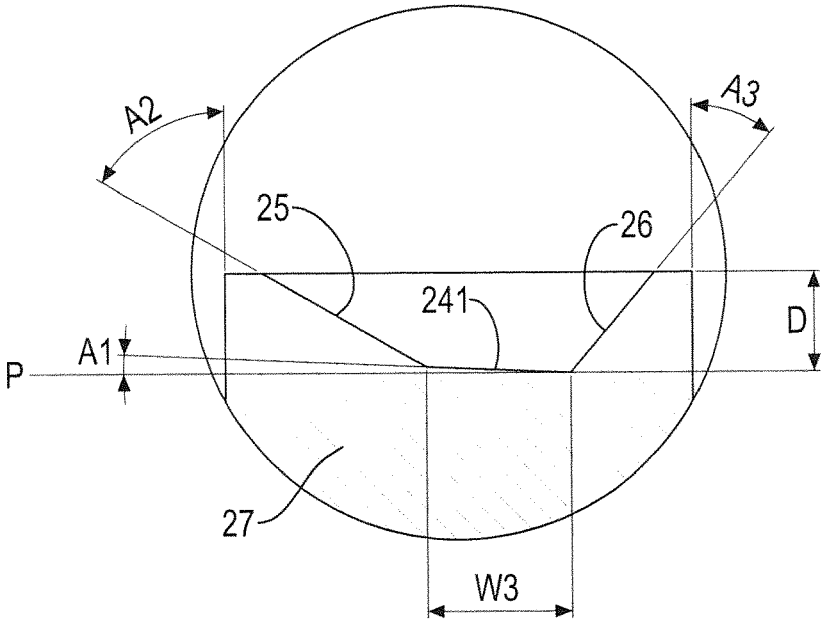
FIG. 5B is a partially enlarged cross sectional side view of the multi-inclined anvil structure in FIG. 5A.

Further with reference to FIGS. 5A and 5B, the depth D formed between the second end of the inclined bottom portion 241 and the top 201 of the body 27 is 0.5 millimeters, and a top depth of an anvil of a conventional stapler is 0.8 millimeters generally. Therefore, the multi-inclined anvil structure 20 of the present invention can force the legs 31 of the staple 30 more easily to provide a well-clinched quality for staples.

Therefore, the multi-inclined anvil structure 20 of the stapler 10 of the present invention can have an improved stapling quality when stapling many or a few sheets of paper. When stapling a few sheets of paper, the legs 31 of the staple 30 can be positioned at the connection position between the inclined bottom portions 241 and the low-sheet-capacity operating surface 26, and abut the inclined bottom portions 241, such that the legs 31 after being positioned cannot slide and can have an improved flattening effect. When stapling many sheets of paper, the legs 31 of the staple 30 can be positioned at the connection position between the inclined bottom portions 241 and the high-sheet-capacity operating surface 25, and abut the high-sheet-capacity operating surface 25. Then, the part of the projection plane 231 of the operating portion 23 adjacent to the first side 21 can provide the narrower width W1, such that the legs 31 having the narrowed piercing width W4 can be clinched smoothly to have an improved clinching effect. In addition, the flattening surface 24 of the multi-inclined anvil structure 20 is inclined relative to the horizontal imaginary plane P, and is not a combination of horizontal surfaces and inclined surfaces. Therefore, the multi-inclined anvil structure 20 of the present invention can be manufactured easily and has a lower manufacturing cost compared to a bottom surface that is combined by horizontal portions and inclined portions of a conventional anvil structure.

From the above description, it is noted that the present invention has the following advantages: the part of the projection plane 231 adjacent to the first side 21 is narrower than the part of the projection plane 231 adjacent to the second side 22, such that when the stapler 10 having the multi-inclined anvil structure 20 is applied to staple many sheets of paper, the legs 31 of the staple 30 can be positioned at the part of the operating portion 23 adjacent to the first side 21 responsive to a situation in which the piercing width W4 becomes narrowed. Therefore, the stapler 10 has the well-clinched quality for the staple 30. The inclined bottom portions 241 have the high front and the low rear, such that when the stapler 10 having the multi-inclined anvil structure 20 is applied to staple a few sheets of paper, the legs 31 of the staple 30 can be positioned smoothly and the staple-sliding problem can be resolved effectively. Furthermore, the flattening surface 24 of the multi-inclined anvil structure 20 is not composed by horizontal surfaces and inclined surfaces, such that the manufacture of the multi-inclined anvil structure 20 is relatively easy and the multi-inclined anvil structure 20 has the relatively low manufacturing cost. Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A multi-inclined anvil structure applied for bending an ejected staple, the multi-inclined anvil structure having:

a body having a horizontal imaginary plane;

a first side;

a second side opposite to the first side; and a top;

an operating portion formed in the body and located between the first side and the second side of the body, the operating portion being recessed downward in the top of the body to form a recess and having a bottom surface, and the operating portion having a projection plane that is parallel with the horizontal imaginary plane, wherein a part of the projection plane adjacent to the first side is narrower than a part of the projection plane adjacent to the second side; and a flattening surface formed in the bottom surface of the operating portion and having two inclined bottom portions being inclined relative to the horizontal imaginary plane, wherein each inclined bottom portion has a first end, a second end, and an inclined state, the first end of the inclined bottom portion is defined as an end of the inclined bottom portion adjacent to the first side of the body, the second end of the inclined bottom portion is defined as an end of the inclined bottom portion adjacent to the second side of the body, the inclined state of each inclined bottom portion is that a position of the inclined bottom portion at the first end of the inclined bottom portion is higher than a position of the inclined bottom portion at the second end of the inclined bottom portion, and an inclined bottom angle is formed between an extension direction of the inclined bottom portions and an extension direction of the horizontal imaginary plane.

2. The multi-inclined anvil structure as claimed in claim 1 further having a high-sheet-capacity operating surface formed in the operation portion, connected between the two inclined bottom portions, and located at the operating portion adjacent to the first side, and the high-sheet-capacity operating surface being inclined relative to the first side and having a high-sheet-capacity operating angle formed between the high-sheet-capacity operating surface and the first side.

3. The multi-inclined anvil structure as claimed in claim 2, wherein a range of the high-sheet-capacity operating angle is 55 degrees to 65 degrees.

4. The multi-inclined anvil structure as claimed in claim 3, wherein the high-sheet-capacity operating angle is 60 degrees.

5. The multi-inclined anvil structure as claimed in claim 3, wherein each inclined bottom portion has an inclined bottom width being a horizontal distance between the first end and the second end of the inclined bottom portion, and the inclined bottom width is 0.8 millimeters.

6. The multi-inclined anvil structure as claimed in claim 2 further having a low-sheet-capacity operating surface formed in the operating portion, connected between the two inclined bottom portions, and located at the operating portion adjacent to the second side, and the low-sheet-capacity operating surface being inclined relative to the second side and having a low-sheet-capacity operating angle formed between the low-sheet-capacity operating surface and the second side.

7. The multi-inclined anvil structure as claimed in claim 6, wherein the high-sheet-capacity operating angle is larger than the low-sheet-capacity operating angle.

8. The multi-inclined anvil structure as claimed in claim 7, wherein a range of the low-sheet-capacity operating angle is 35 degrees to 45 degrees.

9. The multi-inclined anvil structure as claimed in claim 8, wherein the low-sheet-capacity operating angle is 40 degrees.

10. The multi-inclined anvil structure as claimed in claim 8, wherein a depth is formed between the second end of the inclined bottom portion and the top of the body, and the depth is 0.5 millimeters.

11. The multi-inclined anvil structure as claimed in claim 7, wherein the projection plane is formed as a trapezoid.

12. The multi-inclined anvil structure as claimed in claim 11, wherein a range of the inclined bottom angle is 2.5 degrees to 3 degrees.

13. The multi-inclined anvil structure as claimed in claim 1, wherein a range of the inclined bottom angle is 2.5 degrees to 3 degrees.

14. A stapler having:

a base having a clinching end;

an arm assembly pivotally mounted on the base;

a magazine assembly pivotally mounted on the base and located between the arm assembly and the base; and a multi-inclined anvil structure disposed on the clinching end of the base and having a body having a horizontal imaginary plane;

a first side;

a second side opposite to the first side; and a top facing toward the arm assembly;

an operating portion formed in the body and located between the first side and the second side, the operating portion being recessed downward in the top of the body to form a recess and having a bottom surface, and the operating portion having a projection plane cut along the horizontal imaginary plane, wherein a part of the projection plane adjacent to the first side is narrower than a part of the projection plane adjacent to the second side; and a flattening surface formed in the bottom surface of the operating portion and having two inclined bottom portions being inclined relative to the horizontal imaginary plane, wherein each inclined bottom portion has a first end, a second end, and an inclined state, the first end of the inclined bottom portion is defined as an end of the inclined bottom portion adjacent to the first side of the body, the second end of the inclined bottom portion is defined as an end of the inclined bottom portion adjacent to the second side of the body, the inclined state of each inclined bottom portion is that a position of the inclined bottom portion at the first end of the inclined bottom portion is higher than a position of the inclined bottom portion at the second end of the inclined bottom portion, and an inclined bottom angle is formed between an extension direction of the inclined bottom portions and an extension direction of the horizontal imaginary plane.

15. The stapler as claimed in claim 14, wherein the multi-inclined anvil structure further has a high-sheet-capacity operating surface formed in the operation portion, connected between the two inclined bottom portions, and located at the operating portion adjacent to the first side, and the high-sheet-capacity operating surface is inclined relative to the first side and has a high-sheet-capacity operating angle formed between the high-sheet-capacity operating surface and the first side, and a range of the high-sheet-capacity operating angle is 55 degrees to 65 degrees.

16. The stapler as claimed in claim 15, wherein the multi-inclined anvil structure further has a low-sheet-capacity operating surface formed in the operating portion, connected between the two inclined bottom portions, and located at the operating portion adjacent to the second side, and the low-sheet-capacity operating surface is inclined relative to the second side and has a low-sheet-capacity operating angle formed between the low-sheet-capacity operating surface and the second side, and the high-sheet-capacity operating angle is larger than the low-sheet-capacity operating angle.

17. The stapler as claimed in claim 16, wherein a range of the low-sheet-capacity operating angle is 35 degrees to 45 degrees.

18. The stapler as claimed in claim 17, wherein a range of the inclined bottom angle is 2.5 degrees to 3 degrees.

19. The stapler as claimed in claim 18, wherein the projection plane is formed as a trapezoid.

20. The stapler as claimed in claim 17, wherein a depth is formed between the second end of the inclined bottom portion and the top of the body, and the depth is 0.5 millimeters.

* * * * *